United States Patent [19]

Tsubota et al.

[11] 4,122,331

[45] Oct. 24, 1978

[54] PASSER COUNTER

[75] Inventors: Naoki Tsubota; Shibuya Satoru, both of Kyoto, Japan

[73] Assignee: Giken Trading Company, Kyoto, Japan

[21] Appl. No.: 802,568

[22] Filed: Jun. 1, 1977

[51] Int. Cl.[2] ..... G07C 9/00

[52] U.S. Cl. ..... 235/92 PK; 235/92 CV; 235/92 R; 235/98 B

[58] Field of Search ..... 235/92 PK, 92 TC, 92 CV, 235/98 B, 98 R; 324/65 R

[56] References Cited

U.S. PATENT DOCUMENTS

| | | | |
|---|---|---|---|
| 3,346,866 | 10/1967 | Bechtel | 235/92 PK |
| 3,593,006 | 7/1971 | McGee et al. | 235/92 PK |
| 3,792,241 | 2/1974 | Sullivan | 235/92 PK |

*Primary Examiner*—Joseph M. Thesz

*Attorney, Agent, or Firm*—Spensley, Horn & Lubitz

[57] ABSTRACT

A device for counting the number of persons entering or exiting a given area including a mat switch having a plurality of normally open independent switches arranged in the form of a ladder and a plurality of resistors each connected to one of the plurality of switches, the switches and the resistors configured such that the output resistance of the mat switch undergoes a monotonic reduction as the switches are successively closed by the pressure of a person's foot as the person to be counted moves in a predetermined direction across the mat switch and a means for converting the change in the output resistance of the mat switch into a signal which is counted.

7 Claims, 2 Drawing Figures

PASSER COUNTER

BACKGROUND OF THE INVENTION

1. Field of Invention

Figure 1:
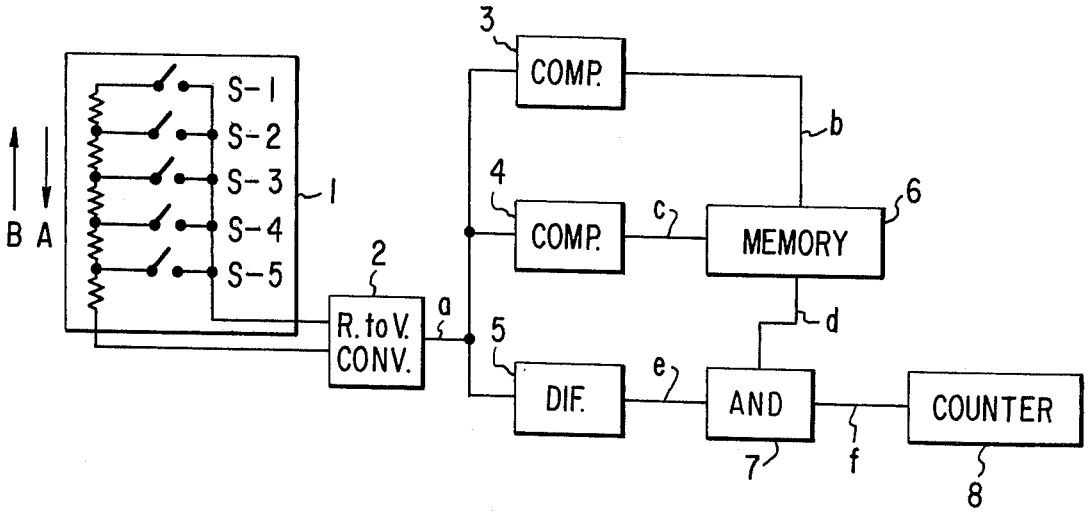

This invention relates to devices for electrically counting the number of persons entering and/or exiting a given area and more particularly to electrical devices for electrically counting the number of persons entering or exiting a given area which also ascertains the direction of movement of the person entering or exiting.

2. Prior Art

In the prior art there are several methods which have been used to count the number of persons entering or exiting a given area. Such methods include: (1) methods in which the counting is done by hand; (2) optical methods; (3) methods utilizing ultrasonic waves; and (4) methods using mat swithces. However, all of these methods suffer from some drawback.

With the methods in category (1) the personnel related cost are very excessive and it is impractuial to utilize such a method for a daily count. Also, error is introduced when large numbers of people are entering and/or exiting at the same time. Methods in category (2) which use infrared or a visable light beam count the number of the times that the beam is interrupted. By installing beams in several locations, the method of category (2) can also be used to ascertain the direction of movement of the person entering or exiting the controlled area. However, when the number of persons entering or exiting the area overlaps with each other as is commonly the case, the methods of category (2) count a single person. Furthermore, in the methods of category (3) ultrasonic waves are emitted and the Doppler effect of the reflected waves is used to count the number of persons entering or exiting the area. However, the board emission pattern makes it impractical to use the method of category (3) when persons are entering and/or exiting in a continuous stream of traffic. Furthermore, it is not possible with the method of category (3) to ascertain the direction of movement of the persons entering or exiting. In the methods of category (4), mat swtiches are installed at the entrances and exits of the given area. The number of persons who step on the mat switches is counted. However, the mthod of category (4) suffers from the drawback of counting only one person when a number of persons are present on the mat switch at the same time.

SUMMARY OF THE INVENTION

Accordingly it is a general object of the present invention to provide a device which can accurately count the number of persons entering or exiting an area.

It is another object of the present invention to provide a device for counting the number of persons which enter or exit an area which can ascertain the direction of movement of such persons.

It is another object of the present invention to provide a device for counting the number of persons entering or exiting a predetermined area which can count large numbers of people which are continuously and simultaneously entering and exiting a given area.

In keeping with the principles of the present invention the objects are accomplished by a unigue device for counting the number of persons entering or exiting a given area. The device includes a mat switch having a plurality of normally open switches arranged in the form of a ladder and a plurality of resistors, each connected to a one of the plurality of switches. The switches and the resistors are configured such that the output resistance of the mat switch undergoes a monotonic reduction as switches are successively switched on by the pressure of a person's foot as the person to be counted moves in a predetermined direction across the mat switch. Accordingly, when the number of persons to be counted pass in an uninterrupted stream across the mat switch in the direction for which a count is desired, each of the mat switches is switched from open to close so that the output resistance of the mat switch undergoes a monotonic reduction. When one person of the continuous stream to be counted has passed completely across the mat switch, the output resistance of the mat switch rises exactly once to a value determined by the closest switch which is closed by the next person to be counted. The device further includes a means for converting the rise in the output resistance of the mat switch into a signal which can be counted by electronic circuitry.

BREIF DESCRIPTION OF THE DRAWINGS

Figure 2:
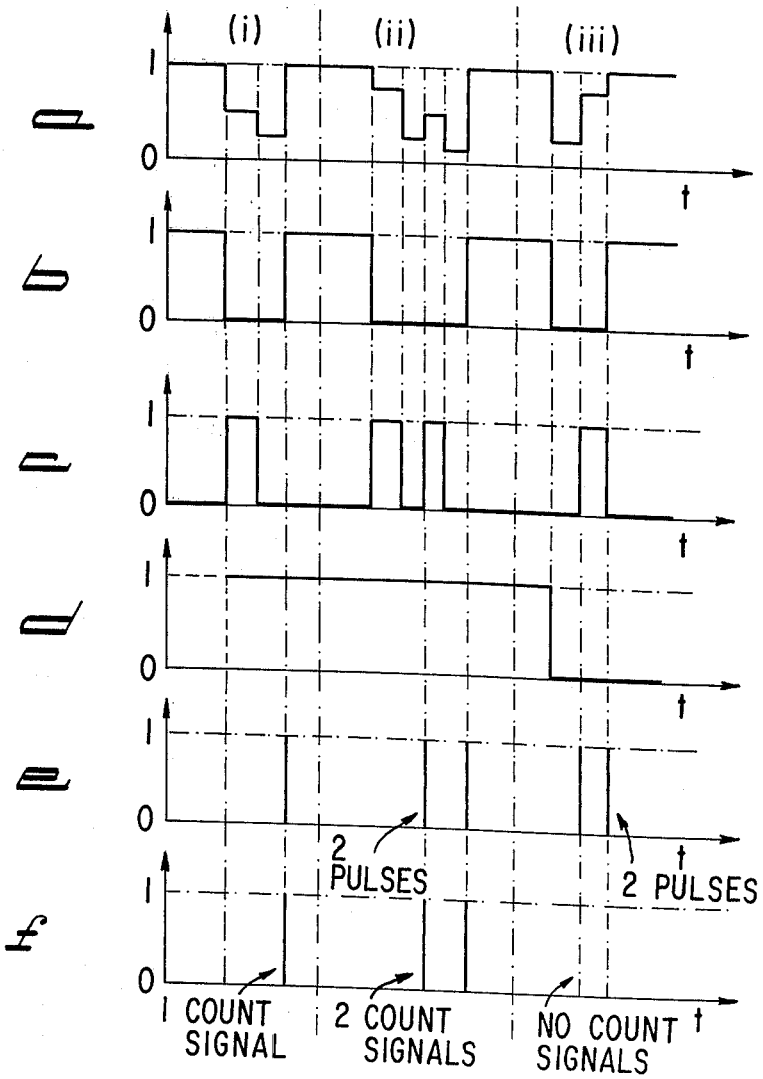

The above mentioned and other features and objects of the present invention will become more apparent by reference to the following description taken in conjunction with the accompanying drawings, wherein like reference numerals denote like elements, and in which:

FIG. 1 is a block diagram of a device for counting the nubmer of persons entering or exiting a given area in accordance with the teachings of the present invention; and FIGS. 2(*a*) through 2(*f*) are the wave forms at points (*a*) through (*f*) in FIG. 1.

DESCRIPTION OF THE INVENTION

Referring more particularly to the drawings, shown in FIG. 1 is a block diagram of a device for counting the number of persons entering or exiting a given area in accordance with the teachings of the present invention. For the counting deive of FIG. 1, certain conditions have been assumed. First, five switches are provided in the mat switch and it is divided into two sections according to a difference in their set levels. When the foot of a person entering or exiting the area leaves the mat switch, the device counts the person. Two directions, *a* and *b*, are distinguished. The direction a is the direction for which a count is desired. However, these conditions have been set up to coincisely and accurately describe the embodiment of FIG. 1. Other possible arrangements without these conditions are described later. In FIG. 1, the device comprises a mat switch 1 consisting of switches S-1 through S-5 which are connected by respective resistances to form a ladder pattern in the circuit. Switches S-1 through S-5 are provided at appropriate intervals so that a person's foot will set on at least one switch. Furthermore, the resistances are each set at an appropriate value so that switches S-1 through S-5 can be distinguished from each other. The output of the mat switch 1 is coupled to a resistance voltage converter 2 and the output of the resistance voltage converter 2 to the input of comparators 3 and 4 and positive direction differentiating circuit 5. The outputs of comparitors 3 and 4 are coupled in input of memory 6 and the outputs of memory 6 and differentiator 5 are coupled to the inputs of AND gate 7. The output of AND gate 7 is coupled to the input of counter 8.

Resistance voltage converter circuit 2, comparitors 3 and 4, differentiating circuit 5, memory circuit 6, AND gate 7 and counter 8 are well known prior art circuits. Furthermore, comparitor 3 is set such that when a person is present on the mat switch 1, it generates a logical zero at its output and if someone is not on mat switch 1 it generates a logical 1 at its output. The level comparitor 4 is arranged and configured such that when a person is present on any of the switches S-1 through S-3, a logical 1 is generated at its output and if a person is not present on switches S-1 through S-3 a logical zero is generated as the output. The positive direction differentiating circuit 5 is designed such that it sends out a pulse signal at the instant at which there is a rise in the voltage from resistance voltage converter 2 which corresponds to the instant at which there is a rise in the output resistance of mat switch 1. Memory 6 is designed so that it retains the input of comparitor 4 occurring at the instant at which the output of level comparitor 3 changes from 1 to zero. When the output of memory circuit 6 is a logical 1, the entrance of a person in the direction for which the count is desired is indicated. When the output of the memory 6 is zero, the entrance of a person in the opposite direction for which a count is desired is indicated. The output of the memory circuit 6 is maintained until the next time that the output of level comparitor 3 changes from 1 to zero (i.e. until the time the next person steps on the mat switch 1 after the mat switch 1 has been completely cleared of people). Accordingly, so long as people are present on the mat switch 1 without interruption, there is no change in the output of memory circuit 6 no matter which switches S-1 through S-5 is stepped on. Therefore, when the output of memory circuit 6 is a logical 1, the and circuit 7 allows the incoming pulses from positive direction differentiating circuit 5 to pass thereby causing a count signal to be sent to counter 8. Furthermore, as previously stated the switches S-1 through S-5 can be distinguished from each other by means of their respective resistances. The resistances applied to switches S-1 through S-5 decrease in value.

In operation, when a person passing in the desired direction indicated by the arrow A steps on one of the switches S-1 through S-3, the voltage at the output of resistance voltage converter 2 reduces in value. This reduction in voltage is applied to comparator 3, comparator 4 and differentiator 5. This reduction in voltage causes comparator 3 to switch from a logical 1 to a logical zero output indicating that a person has stepped on the mat switch. In addition, comparator 4 switches from a logical zero to a logical 1 indicating that one of the switches S-1 through S-3 has been closed. Since the output of comparator 3 has changed from a logical 1 to a logical zero memory 6 changes to the output of comparator 4 which is a logical 1. The logical 1 from memory 6 is applied to AND gate 7 and is held. Positive direction differentiating circuit 5 differentiates the negative going voltage from converter 2 is not passed by the positive direction differentiator 5 and no signal is passed through the AND gate 7 to the counter 8. When the person then takes another step and caused one of the other switches to close, the voltage from converter 2 again reduces in magnitude. Since the comparator 3 already is generating a logical zero at its output, it does not change its output and the output of memory 6 remains the same or in otherwords a logical 1. When the individual then steps off of the mat switch 1, all of the switches S-1 through S-5 are now open and the voltage from converter 2 suddenly rises. The sudden rise in the voltage from converter 2 causes comparator 3 to change its output from a logical zero to a logical 1. Since the output of converter 3 changes from a logical zero to a logical 1, the output of memory 6 again does not change and is a logical 1.

The positive going voltage from converter 2 is applied to positive direction differentiator 5 where it is differentiated into a positive going pulse which is applied to AND gate 7. Since a logical 1 is applied to one input of AND gate 7 and the positive pulse from differentiator 5 is applied to the other input of AND gate 7, a output signal appears at the output of AND GATE 7 which is counted by counter 8.

If a person steps onto the mat switch 1 in the direction indicated by arrow B, he will first cause either switch S-4 or S-5 to close causing the output voltage of converter 2 to decrease. This reduction in the output voltage of converter 2 causes the output of comparator 3 to change states from a logical 1 to a logical zero. Since none of the switches S-1 through S-3 has been closed, the output of comparator 4 is still a zero. Since the output of comparator 4 is a logical zero and the output of comparitor 3 is changed from a logical 1 to a logical zero, the output of memory 6 is a logical zero which is applied to one input of AND gate 7. When the person then takes another step and causes one of the switches S-1 through S-3 to close, the output voltage of converter 2 rises slightly. This slight rise in voltage does not cause comparator 3 to change states from a logical zero to a logical 1 since someone is still present on the mat switch 1. Since one of the switches S-1 through S-3 has been caused to close, the output of comparator 4 changes from a logical zero to a logical 1. Since the output of comparator 3 has not changed from a logical 1 to a logical zero, the output of memory 6 does not change but remains at a logical zero. When the person then steps off of the mat, the voltage at the output of converter 2 takes a sudden increase. This sudden increase causes the output of comparator 3 to change from a logical zero to a logical 1 and the output of comparator 4 to change from a logical 1 to a logical zero. Therefore, the output of memory 6 is still a logical zero which is applied to the input of AND gate 7. The positive going voltage is differentiated by the positive direction differentiator 5 and applied to one input of AND gate 7. Since a logical zero is applied to the other input of AND gate 7, no output signal appears at the output of AND gate 7 and nothing is counted by counter 8.

From the foregoing it should be apparent that if an uninterrupted stream of traffic in the direction for which a count is desired (the direction indicated by arrow A) were to pass over the mat switch 1, the output signals from AND gate 7 which would be counted by counter 8 would exactly correspond to the number of persons passing over the mat switch 1 in the desired direction since the resistance of the switch being stepped on by the person in the rear is always higher than the resistance of the switch being stepped on by a person in front thereby causing the voltage from generator 2 to go down. Accordingly, the output of the converter 2 and therefore the output of the differentiator 5 will only be a positive going pulse when a person steps off of the mat swtich 1.

As shown in FIGS. 2(*a*) through 2(*f*), portion (*i*) when the first person steps onto the mat switch 1, one of the switches S-1 through S-3 is closed thereby causing the voltage at the output of converter 2 to decrease as shown in FIG. 2(*a*). This decrease in voltage at the output of converter 2 causes the output of comparator 3 to change from a logical 1 to a logical zero as shown in FIG. 2(*b* ) and the output of comparator 4 to change from a logical zero to a logical 1 as shown in FIG. 2(*c*). Since the output of comparator 3 has changed from a logical 1 to a logical zero and the output of comparator 4 has changed from a logical zero to a logical 1, the output of memory 6 becomes a logical 1 as shown in FIG. 2(*d*). Since the output voltage of converter 2 is negative voltage, the output of differentiator 5 and the output of AND gate 7 is a logical zero as shown in FIGS. 2(*e*) and 2(*f*).

When the first person then takes another step and steps onto switch S-4 or S-5 and a second person steps onto the mat switch 1 and steps onto one of the switches S-1 through S-3 the output voltage of converter 2 again drops as shown in FIG. 2(*a*). When the voltage drops again, the output of comparator 3 remains a logical zero and the output of comparator 4 changes from a logical 1 to a logical zero. Since the output of comparator 3 has not changed from a logical 1 to a logical zero the output of memory 6 remains a logical 1 as shown in FIG. 2(*d*). Furthermore, since the voltage change is a negative going voltage, the output of differentiator 5 and therefore the output of AND gate 7 is a logical zero as shown in FIGS. 2(*c*) and 2(*f*). When the first person then steps off of the mat switch 1, the output voltage of covnerter 2 rises as shown in FIG. 2(*a*). Since a person is still present on the mat and that person is standing on one of the switches S-1 through S-3, the output of comparator 3 remains a zero and the output of comparitor 4 changes from a logical zero to a logical 1 as shown in FIGS. 2(*b*) and 2(*c*). Since the output of comparator 3 has not changed from a logical 1 to a logical zero the output of memory 6 remains at a logical 1. Since the voltage from the converter 2 is a positive going voltage, the voltage is differentiated by the positive direction differentiator 5 and an output pulse is generated as shown in FIG. 2(*e*). Since a logical 1 is present at one input of the AND gate 7 and a logical 1 pulse is applied to the other input of AND gate 7, and logical 1 appears at the output of AND gate 7 which is applied to counter 8 where it is counted.

When the second person then takes a step and steps onto switches S-4 or S-5, the output voltage of converter 2 agains drops as shown in FIG. 2(*a*). As previously described the output of comparator 3 remains at a logical zero as shown in FIG. 2(*b*), the output of comparator 4 changes from a logical 1 to a logical zero as shown in FIG. 2(*c*), the output of memory 6 remains at a logical 1 as shown in FIG. 2(*d*) and the output of differentiator 5 and AND gate 7 remain at a logical zero as shown in FIGS. 2(*e*) and 2(*f*).

When the second person then steps off the switch mat 1, the output voltage of converter 2 suddenly rises as shown in FIG. 2(*a*). As previously described, the output signal of comparator 3 then changes from a logical zero to a logical 1 as shown in FIG. 2(*b*), the output of comparator 4 remains at a logical zero as shown in FIG. 2(*c*), the output of memory 6 remains at a logical 1 as shown in FIG. 2(*d*) and the outputs of positive direction differentiator 5 and AND gate 7 is logical 1 pulse as shown in FIGS. 2(*e*), 2(*f*) which is counted by counter 8.

It should be apparent to one skilled in the art that there are no intrinsic limitations upon the number of independent switches utilized in the mat switch 1. The of independent switches in the mat switch 1 is limited rather by the location at which the mat switch is installed. The division of the mat switch 1 into sections for the purpose of ascertaining the direction of movement can be accomplished by establishing any number of sections with different set levels. However, installing a large number of sections merely increases the complexity of the system. For most instances two sections should be sufficient. Furthermore, the level comparators 3 and 4, the memory circuit 6 and the AND circuits 7 are unnecessary in cases where there is no need to ascertain the direction of movement. In such cases, the number of persons passing in an uninterrupted stream of traffic can be ascertained by merely counting the number of pulse signals from the positive direction differentiating circuit. In addition, belt shaped, point or disc shaped switches could be utilized with the device of the present invention.

From the foregoing description, it should be apparent that the device for counting the number or persons entering or exiting a given area possesses the following merits:

1. Since it is constantly in operation, it can provide data concerning day to day changes or variations according to the time of day, etc. and the number of persons entering and/or exiting a given area.

2. By installing a multiple number of independent switches and reading changes in resistance, this device is able to accurately count the number of persons passing across the mat switch 1 regardless of the precise length of each person's stride.

3. By varying set levels of the independent switches so that they are divided into more than one section, this device is able to ascertain the direction of movement of the persons passing across the mat switch 1. Although conventional methods for ascertaining the direction of movement require that a person pass at least two points, the device in accordance with the teachings of the present invention is able to ascertain the direction of movement at the first step of the person passing across. Furthermore, the device in accordance with the teachings of the present invention is also effective in cases where there is movement in more than two directions.

4. The device according to the present invention is also able to obtain the signals required with two output lines by installing the latter resistances in the mat switch 1. Accordingly, the mat switch 1 is easy to work with.

In all cases it is understood that the above described embodiment is merely illustrative of but one of the many possible specific embodiments which can represent applications of the principles of the present invention. Numerous and varied arrangements can be readily devised by those skilled in the art without departing from the spirit and scope of the invention.

We claim:

1. A device for counting the number of persons communicating within a given area comprising:

a mat switch having a plurality of switches and a plurality of serially coupled resistors forming a series of nodes, each said switch having a first terminal coupled to one of said nodes and a second terminal coupled to a common output node, said switches and said resistors configured such that an output resistance of said mat switch undergoes a monotonic change as the switches are successively actuation by pressure of a person's foot on said mat switch as said person to be counted moves in a predetermined direction across said mat switch; and first means for converting the changes in said output resistance into a signal to be counted, said first means coupled to said output node and one of said resistors; and second means for counting said signals to obtain a cumulative sum.

2. A counting device according to claim 1 wherein said first means for converting the changes in said output resistance into a signal to be counted comprises a resistance to voltage converter.

3. A counting device according to claim 2 further comprising a differentiating circuit coupled to a voltage output of said resistance to voltage converter wherein said second means has an input coupled to the output of said differentiating circuit.

4. A counting device according to claim 3 wherein said plurality of switches are arranged and configured in said mat switch such that at least the actuation of a first and a second group of said switches can be distinguished from each other.

5. A counting device according to claim 4 further comprising:

a first comparator coupled to said voltage output of said resistance to voltage converter, said first comparator being configured such that at least one of said switches is actuated the output of said first comparator changes from a logical 1 to a logical 0;

a second comparator coupled to said voltage output of said resistance to voltage converter, said second comparator being configured such that when at least one of said first group of switches is actuated the output of said second comparator changes from a logical 0 to a logical 1;

a memory circuit coupled to both said first and second comparators and responsive to said first comparator such that the output of said memory circuit is set and maintained at the output of said second comparator existing at the instant at which the output of said first comparator changes from a logical 1 to a logical 0; and an AND gate provided such that said AND gate's inputs are the outputs of said differentiating circuit and said memory circuit and said AND gate's output is coupled to the input of said second means for counting.

6. A circuit for counting the movement of a plurality of objects through a predetermined area and in a predetermined direction comprising:

sensor means for detecting the presence of one of said objects within said predetermined area and for generating a monotonic output signal in response to said movement of said objects through said predetermined area, said predetermined area having a first and second subarea, said first subarea having an entry perimeter, movement from said first subarea to said second subarea being in said predetermined direction, said monotonic output signal assuming a value substantially dependent on that one of said plurality of objects furthest from said entry perimeter of said first subarea;

first comparator means for generating a sampling trigger signal in response to said monotonic output signal to indicate movement of said object into said predetermined area, said first comparator means being coupled to said sensor means;

second comparator means for generating a subarea identification signal in response to said monotonic ouput signal to indicate whether said objects is in said second subarea, said second comparator means being coupled to said sensing means;

memory means for sampling said second comparator means and for generating a stored, gating signal logically equivalent to said subarea identification signal, said stored gating signal being generated in response to said sampling trigger signal, said memory means being coupled to said first and second comparator means;

differentiating means for differentiating said monotonic output signal to generate a count in response to the differentiated monotonic output signal when the derivative of said monotonic output signal assumes a predetermined sign to indicate movement of said object in said predetermined direction, said differentiating means being coupled to said sensor means;

gating means for gating said count to an output terminal in response to said stored gating signal, said gating means being coupled to said differentiating means and said memory means; and counting means for cumulatively counting said counts at said output terminal, said counting means coupled to said output terminal.

whereby when said object enters said predetermined area said memory means samples said second comparator means in response to said sampling trigger signal from said first comparator means, said subarea identification signal indicating whether said object entered said predetermined area in the first or second subareas, said gating means gating said count to said output terminal only if said object entered said first subarea as indicated by said gating signal from said memory means, said count being generated whenever the derivative of said monotonic output signal assumes said predetermined sign.

7. The circuit of claim 6 wherein said sensor means comprises:

a plurality of serially coupled resistors defining a plurality of nodal points, including a first nodal point, each nodal point coupled to one terminal of a momentary contact switch having another terminal coupled to a common node, said plurality of momentary contact switches being linearly disposed through said predetermined area; and converter means for generating said monotonic output signal proportional to the resistance between said common node and first nodal point.

* * * * *